US009347200B2

(12) United States Patent
Hennemann et al.

(10) Patent No.: US 9,347,200 B2
(45) Date of Patent: May 24, 2016

(54) FLUID CONTROL SYSTEM FOR WORK VEHICLE

(75) Inventors: Matthew J. Hennemann, Burlington, IA (US); Richard J. Lech, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 964 days.

(21) Appl. No.: 13/487,622

(22) Filed: Jun. 4, 2012

(65) Prior Publication Data

US 2013/0318957 A1 Dec. 5, 2013

(51) Int. Cl.

| | |
|---|---|
| ***F15B 15/20*** | (2006.01) |
| ***E02F 3/96*** | (2006.01) |
| ***F15B 13/04*** | (2006.01) |
| ***E02F 9/22*** | (2006.01) |

(52) U.S. Cl.

CPC ..... *E02F 3/964* (2013.01); *E02F 9/2232* (2013.01); *E02F 9/2296* (2013.01); *F15B 13/0416* (2013.01); *F15B 2211/605* (2013.01); *F15B 2211/6051* (2013.01); *F15B 2211/6057* (2013.01); *F15B 2211/65* (2013.01)

(58) Field of Classification Search

CPC ..... E02F 3/964; E02F 9/2296; E02F 9/2232; F15B 13/0416; F15B 2211/65; F15B 2211/605; F15B 2211/6051; F15B 2211/6057; F15B 15/20

USPC ..... 60/446, 451, 458

See application file for complete search history.

(56) References Cited

U.S. PATENT DOCUMENTS

| | | | | |
|---|---|---|---|---|
| 3,726,089 | A | 4/1973 | Boydell | |
| 3,788,077 | A | 1/1974 | Johnson et al. | |
| 3,809,501 | A | 5/1974 | Weisenbach | |
| 3,952,509 | A | 4/1976 | Coleman | |
| 4,335,577 | A | 6/1982 | Lobmeyer et al. | |
| 4,383,412 | A | 5/1983 | Presley | |
| 4,479,349 | A | 10/1984 | Westveer | |
| 5,077,975 | A * | 1/1992 | Kauss | 60/452 |
| 5,528,911 | A * | 6/1996 | Roth et al. | 60/452 |
| 2009/0025380 | A1 | 1/2009 | Harsia | |
| 2009/0229261 | A1 | 9/2009 | Lin et al. | |

* cited by examiner

*Primary Examiner* — Dwayne J White
*Assistant Examiner* — Logan Kraft
(74) *Attorney, Agent, or Firm* — Patrick M. Sheldrake

(57) ABSTRACT

A fluid control system including a variable displacement pump having a load system control and configured to operate in an open center mode. A pump control is operable between a first arrangement and a second arrangement. The pump control receives pressurized fluid from a first load sensor pressure in fluid communication with the pump and an actuator return pressure in fluid communication with an actuator configured to operate using pressurized fluid from the system, the pump control providing a selective pump control pressure to the pump load system control. When the system is operating in a standby mode, the pump operates in a first minimized displacement condition. When the system is in a stall mode, the pump operates in a second minimized displacement condition.

14 Claims, 5 Drawing Sheets

FLUID CONTROL SYSTEM FOR WORK VEHICLE

FIELD OF THE INVENTION

The present invention relates generally to the field of work vehicles. It relates more particularly to work vehicles having a fluid control system for manipulating attachments.

BACKGROUND OF THE INVENTION

With a focus on fuel economy and increasing system pressures to achieve greater levels of machine performance, there is a trend for more hydraulic or fluid systems to utilize a variable displacement pump. The variable displacement pump is more efficient, and its abilities to "destroke", i.e., operating at reduced displacement and/or pressure levels, can reduce fuel consumption. In an attempt to maximize efficiency, most variable displacement pumps operate in a closed center mode, in which generally, the system provides maximum fluid pressure to the control valves of the system, irrespective of whether the valves are actuated or not. The pumps vary their flow rate, pumping significantly reduced amounts of pressurized fluid until an operator actuates a valve associated with a hydraulic actuator controlling an attachment, such as associated with operation of a work vehicle, for example, a backhoe or backhoe loader. A benefit of a closed center system is that a hydraulic pump is destroked at stall and also at standby conditions, only supplying a required flow of pressurized fluid upon demand, which reduces losses associated with system operation. However, operating in a closed center mode increases the complexity of the system, resulting in increased operating costs.

Variable displacement pumps can also be used in an open center operating mode, in which the pump provides a continuous flow of pressurized fluid to the system. While systems utilizing a conventional open center operating mode are less complex and therefore less expensive to operate his compared to operating in a closed center mode, there are drawbacks associated with a conventional open center operating mode. For example, in a standby condition, the pump operates at a maximum displacement condition, resulting in lower operating efficiencies.

Accordingly, it would be desirable to inexpensively operate a pump in an open center mode that would permit the pump to operate at a destroked or minimized displacement condition in response to the system operating in either a standby mode or a stall mode.

SUMMARY OF THE INVENTION

The present invention relates to a fluid control system including a variable displacement pump having a load system control and configured to operate in an open center mode. A pump control is operable between a first arrangement and a second arrangement, the pump control receiving pressurized fluid from a first load sensor pressure in fluid communication with the pump and an actuator return pressure in fluid communication with an actuator configured to operate using pressurized fluid from the system. The pump control provides a selective pump control pressure to the pump load system control. When the system is operating in a standby mode, the pump control is urged to the first arrangement, the pump control pressure being insufficient to overcome the first load sensor pressure applied to the pump load system control, resulting in the pump operating in a first minimized displacement condition. When the system is in a stall mode, the pump control is urged to the second arrangement, the pump control pressure being sufficient to overcome the first load sensor pressure applied to the pump load system control, resulting in the pump operating in a second minimized displacement condition.

The present invention further relates to a work machine including a variable displacement pump having a load system control and configured to operate in an open center mode. A pump control is operable between a first arrangement and a second arrangement, the pump control receiving pressurized fluid from a first load sensor pressure in fluid communication with the pump and an actuator return pressure in fluid communication with an actuator configured to operate using pressurized fluid from the system. The pump control provides a selective pump control pressure to the pump load system control. When the system is operating in a standby mode, the pump control is urged to the first arrangement, the pump control pressure being insufficient to overcome the first load sensor pressure applied to the pump load system control, resulting in the pump operating in a first minimized displacement condition. When the system is in a stall mode, the pump control is urged to the second arrangement, the pump control pressure being sufficient to overcome the first load sensor pressure applied to the pump load system control, resulting in the pump operating in a second minimized displacement condition.

An advantage of the present invention is the capability to inexpensively operate a pump in an open center mode, in which the pump can operate in a destroke or minimized displacement condition while the system operates in either a standby mode or a stall mode.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
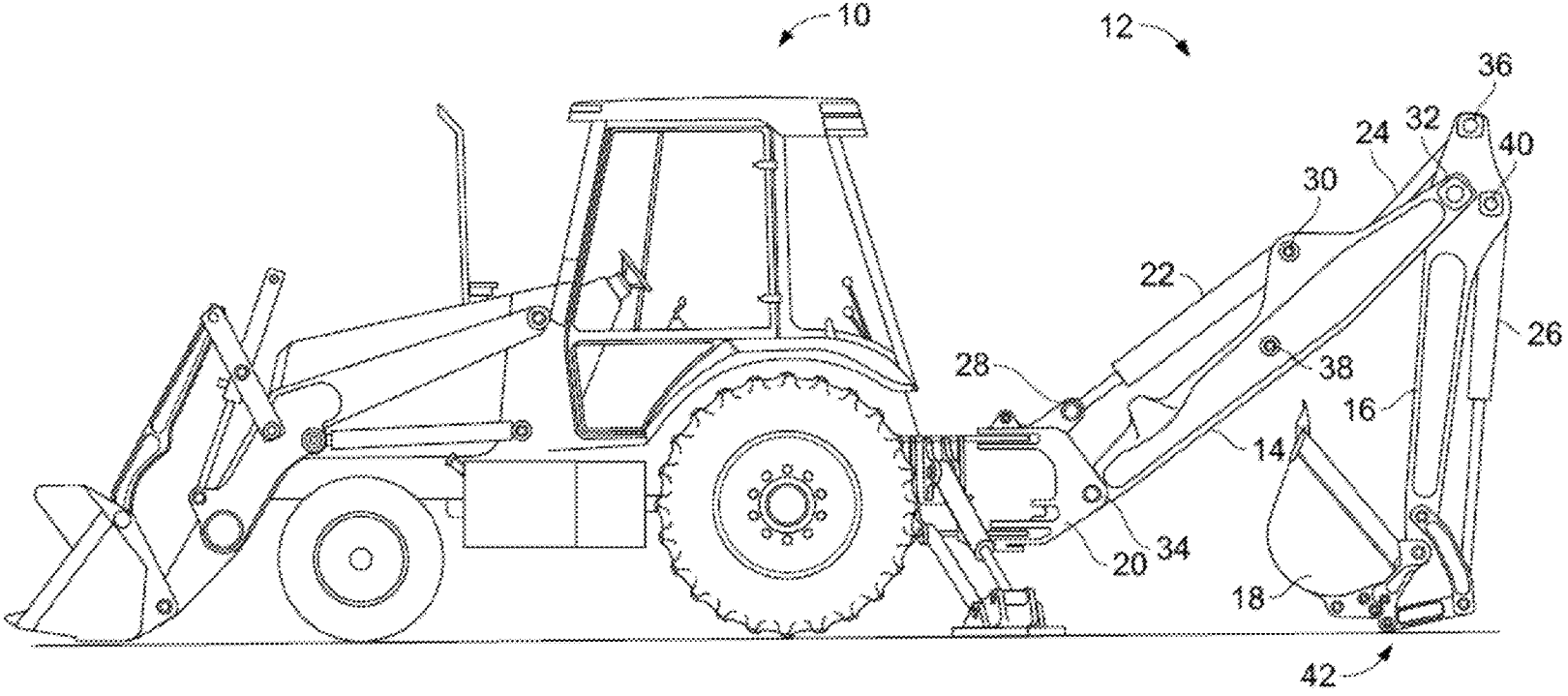
FIG. 1 shows a top perspective view of an embodiment of a work machine of the present invention.

Referring to the drawings for a description of an earthworking machine 10 that employs the present invention, FIG. 1 shows a boom 14 in a lowered position. Boom 14 pivots about a pivot joint 34 and coincident pivot axis of a frame 20 and is controlled by extension/contraction of an actuator or fluid ram 22 connected between pivot joints 28, 30. Similarly, an arm 16, often referred to as a dipper, pivots about pivot joint 32 of boom 14 and is controlled by extension/contraction of an actuator or fluid ram 24 connected between pivot joints 36, 38. In addition, implement or attachment 18, such as a bucket, is pivotably connected to arm 16 and is controlled by extension/contraction of an actuator or fluid ram 26 connected between pivot joint 40 and interconnected linkages 42. A backhoe 12 comprises the combination of boom 14, arm 16, implement 18 and pivoting connections therebetween.

Figure 2:
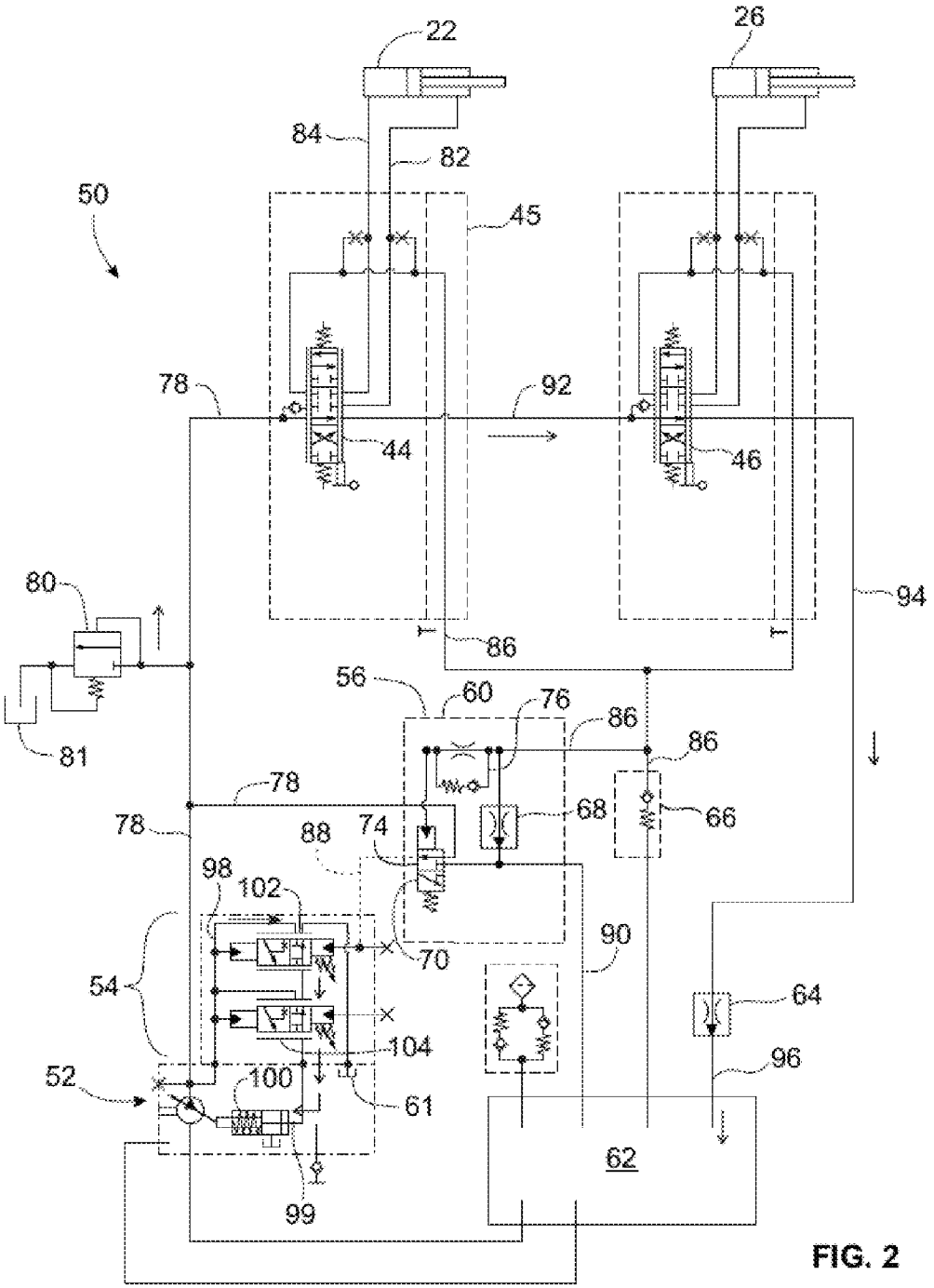
FIGS. 2-5 show schematics of a fluid control system of the present invention.
Figure 3:
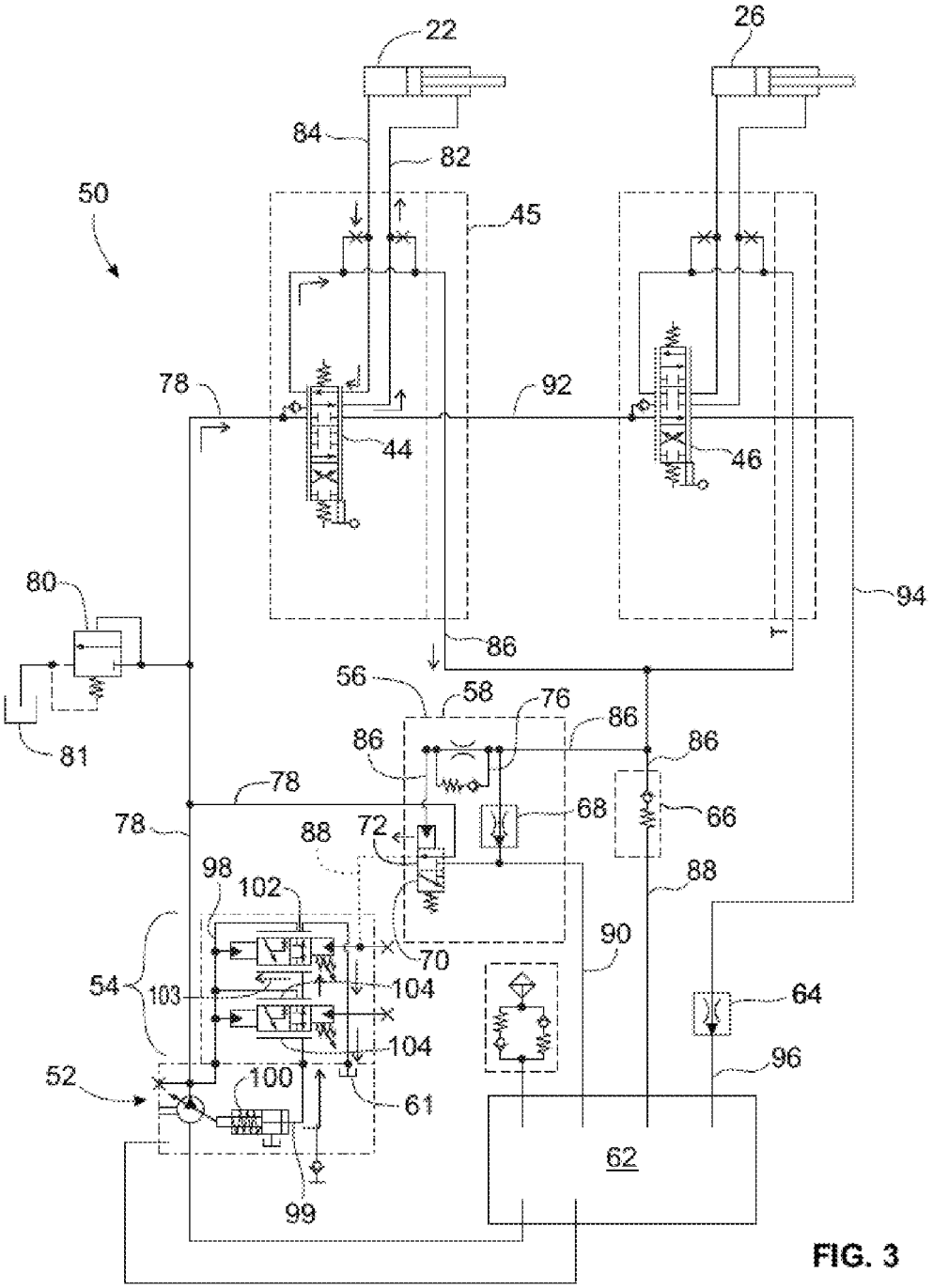
Figure 4:
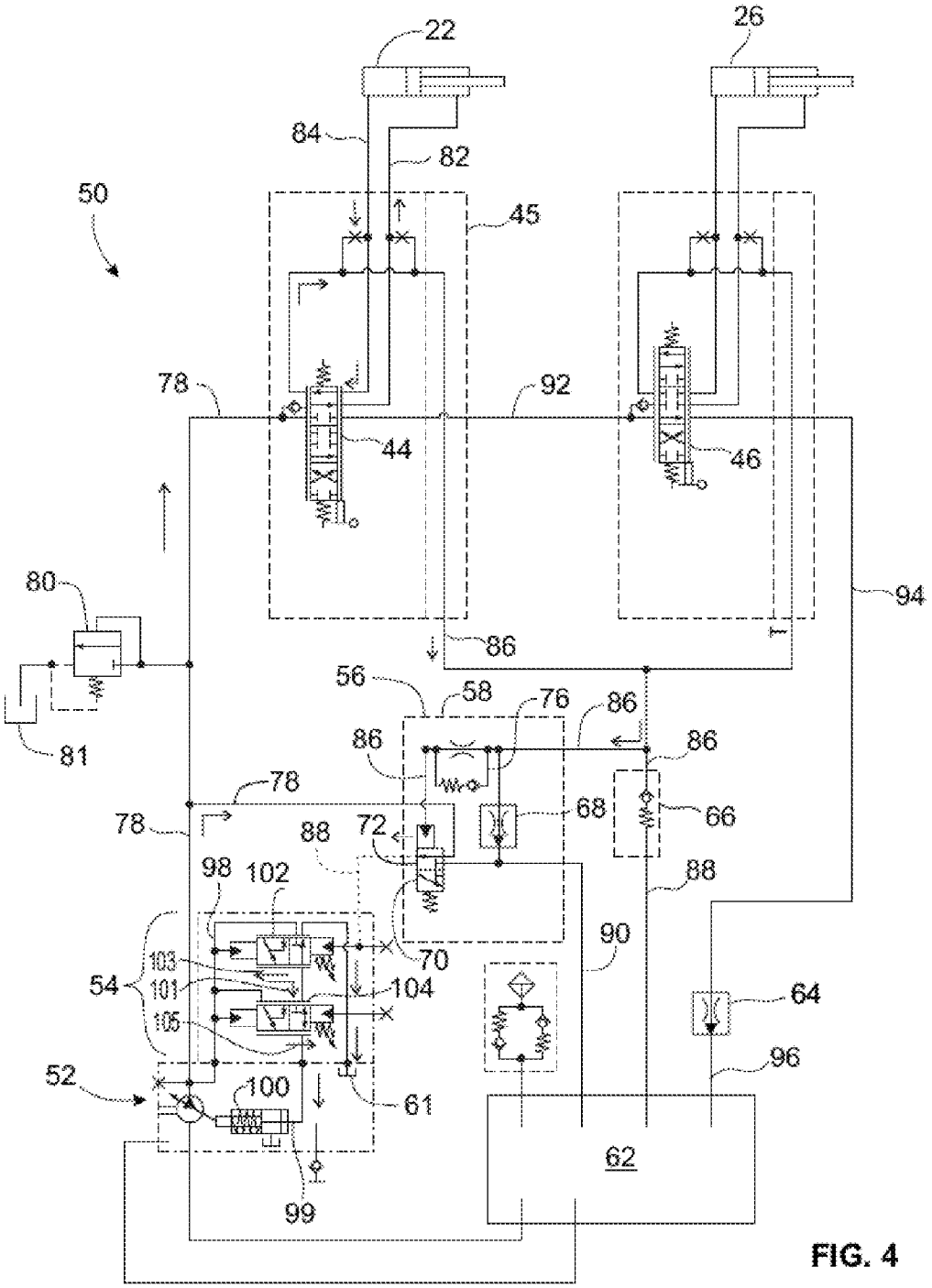

FIGS. 2-4 show respective standby, working and stall operating modes associated with a fluid control system 50. Fluid control system 50 includes a variable displacement pump 52 having a load system control 54, with pump 52 being configured to operate in an open center mode. Fluid control system 50 further includes a pump control 56 having a first arrangement 60 and a second arrangement 58 as will be discussed in further detail below. As shown in the exemplary embodiment of fluid control system 50, fluid rams 22, 26 may be associated with a working machine 10 such as a backhoe or backhoe loader. Fluid rams 22, 26 are controlled by respective operator control valves 44, 46, with control valve 44 being contained within operator control valve assembly 45.

As further shown FIG. 2, fluid control system 50 is operating in a standby mode. A first load sensor pressure is generated by pump 52 inside of a line 78 that bifurcates and is provided to pump control 56 and operator control valve 44 of operator control valve assembly 45. In standby mode, first load sensor pressure flowing inside of line 78 flows through operator control valve 44 of operator control valve assembly 45, to line 92, which then flows through operator control valve 46, to line 94 which encounters a first flow restriction device 64. In one embodiment, first flow restriction device 64 is configured to permit fluid flow therethrough at a pressure greater than a pressure required to flow through a second flow restriction device 66, the pressure required to flow through the second floor restriction device 66 similarly being greater than a pressure required to flow through a third flow restriction device 68 associated with pump control 56. Upon encountering first flow restriction device 64 in standby mode, the first load sensor pressure contained inside line 94 is configured to flow through the first flow restriction device 64, and then to line 96 which is in fluid communication with reservoir 62. As further shown in FIG. 2 in standby mode, with the pressurized fluid being blocked by respective control valves 44, 46 from activating either of actuators 22, 26, an actuator return pressure contained inside of line 86 is low. That is, the actuator return pressure, which is associated with the return pressure of respective actuators 22, 26 that are inactive during standby mode, is less than a pressure magnitude required to overcome either second flow restriction device 66 or to actuate pump control valve 70 away from a second position 74. With pump control valve 70 in second position 74, first load sensor pressure contained in line 78 is blocked by pump control valve 70. Consequently, the magnitude of pump control pressure contained in line 88 and in fluid communication with load system control 54 and to a reservoir 62 via line 90, is insufficient to overcome the position of control valve 102 associated with load system control 54. As a further result, first load sensor pressure contained in line 98, which is substantially the same pressure as the first load sensor pressure contained in line 78, is insufficient to overcome the position of control valve 104 associated with load system control 54. First load sensor pressure contained in line 98 flows through the control valves 102, 104 associated with load system control 54 and into line 99, actuating a control piston 100 associated with pump 52. As a result, with the pressures associated with control piston 100 of pump 52 and the pump being substantially equal, the spring in the control piston would extend, resulting in the pump operating in a minimized displacement condition, i.e., the pump being destroked.

FIG. 3 shows a working mode for fluid control system 50, in which, for example, an operator calls for pressurized fluid to actuator 22 by activating the spool position associated with operator control valve 44. As a result, first load sensor pressure contained in line 78 as generated by pump 52 passes through operator control valve 44 of operator control valve assembly 45, then through line 82 to provide the pressurized fluid to actuator 22 in order to actuate the associated fluid-operated attachment. The return pressure from actuator 22 contained in line 84 enters operator control valve assembly member 45, and exits operator control valve assembly 45 at line 86, and is identified as actuator return pressure. The actuator return pressure contained in line 86 passes through an optional first flow direction control device 76 and is regulated in parallel by a third flow restriction device 68 that is in fluid communication with reservoir 62 via line 90. In working mode, the magnitude of the actuator return pressure is sufficient to actuate pump control valve 70 from second position 74 (FIG. 2) to first position 72, permitting first load sensor pressure contained in line 78 to pass through pump control valve 70. As a result, the pump control pressure contained in line 88 is substantially the same pressure as the first load sensor pressure contained in line 78. As further shown in FIG. 3 in working mode, with pump control valve 70 in first position 72, the magnitude of pump control pressure contained in line 88 that is in fluid communication with load system control 54 is sufficient to overcome control valve 102 associated with load system control 54 to move the spool of control valve 102 in a spool actuation direction 103. As a further result, first load sensor pressure contained in line 98, which is substantially the same pressure as first load sensor pressure as contained in line 78, is insufficient to overcome the positions of the spools of control valves 102, 104 associated with load system control 54, with the first load sensor pressure being blocked by the spools of control valves 102, 104 of load system control 54 from reaching line 99 that is in fluid communication with control piston 100, pressurized fluid associated with reducing the operational displacement of pump 52 to be vented to reservoir 61. Stated another way, the displacement of pump 52 is permitted to be stroked, or urged toward an increased displacement pumping position.

FIG. 4 shows a stall mode for fluid control system 50, in which, for example, an operator calls for pressurized fluid to actuator 22 by activating the spool position associated with operator control valve 44. As a result, first load sensor pressure contained in line 78 as generated by pump 52, which corresponds to a maximum pump pressure, passes through operator control valve 44 of operator control valve assembly 45, then through line 82 to provide the pressurized fluid to actuator 22 in order to attempt to actuate the associated fluid-operated attachment. The return pressure from actuator 22 contained in line 84 enters operator control valve assembly member 45, and exits operator control valve assembly 45 at line 86, and is identified as actuator return pressure. The actuator return pressure contained in line 86 passes through an optional first flow direction control device 76 and is regulated in parallel by a third flow restriction device 68 that is in fluid communication with reservoir 62 via line 90. In stall mode, the magnitude of the actuator return pressure is sufficient to actuate pump control valve 70 from second position 74 (FIG. 2) to first position 72, permitting first load sensor pressure contained in line 78 to pass through pump control valve 70. As a result, the pump control pressure contained in line 88 is substantially the same pressure as the first load sensor pressure contained in line 78. As further shown in FIG. 4 in stall mode, with pump control valve 70 in first position 72, the magnitude of pump control pressure contained in line 88 that is in fluid communication with load system control 54 is sufficient to overcome the position of control valve 102 associated with load system control 54. That is, the spool of control valve 102 is actuated in spool actuation direction 103. As a further result, first load sensor pressure contained in line 98, which is substantially the same pressure as first load sensor pressure as contained in line 78 and load system control 54 is sufficient to overcome the position of control valve 104 associated with load system control 54. That is, the spool of control valve 104 is actuated in spool actuation direction 105. As a further result, first load sensor pressure, which in a stall mode is at maximum pump pressure, is contained in line 98 and flows through control valve 104 of load system control 54, and is in fluid communication with line 99 that is in fluid communication with control piston 100. Additionally, the spool of control valve 104 is also in fluid communication with line 101, permitting pressurized fluid associated with controlling the pressure output of pump 52 to be vented to reservoir 61. Since the pressure levels of the first load sensor pressure and control piston 100 are substantially equal in stall mode, the pump must merely maintain the maximum pump output pressure. Stated another way, the displacement of pump 52 is permitted to be destroked, or urged toward a maximum pressure pumping position having a low displacement.

It is to be understood that even when a pump is fully destroked, the pump still delivers a minimum flow of pressurized fluid. In the event that the demand for pressurized fluid is less than the minimum flow of the pump, the magnitude of fluid pressure would continue to increase. To prevent overpressurization of fluid in the system, a relief valve 80 is placed in fluid communication with line 78, such that in response to an overpressurization condition in line 78, relief valve 80 is actuated in order to vent overpressurized fluid to reservoir 81.

In an alternate arrangement of the stall mode, in place of control valves 102, 104 of load system control 54 of pump 52, pump control pressure provided via line 88 in combination with a direct pump line, similar to line 98, except with the addition of a flow restriction device, such as similar to third flow restriction device 68 in combination with a conventional load sensing relief valve, in order to control the stall condition of the pump.

In addition, power beyond capability, providing control valve priority for use with a plurality of control valves as is well known, may be incorporated into the system.

Figure 5:
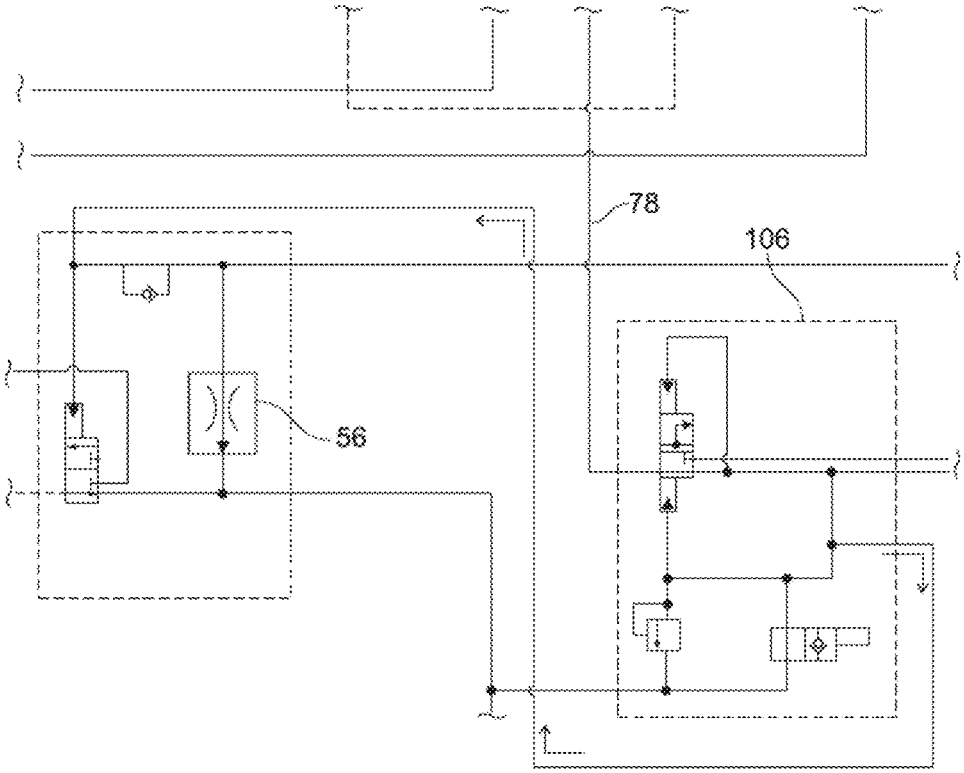

It is to be understood that the control system of the present disclosure can be used with uni-directional auxiliary attachments 106, such as shown in FIG. 5, in which uni-directional auxiliary attachments 106, such as a hammer, receives pressurized fluid from line 78 as previously discussed. The return pressure from uni-directional auxiliary attachments 106 is contained in line 108 and connected to pump control 56, also as previously discussed.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fluid control system comprising:

a variable displacement pump having a load system control and configured to operate in an open center mode; and a pump control operable between a first arrangement and a second arrangement, the pump control receiving pressurized fluid from a first load sensor pressure in fluid communication with the pump and an actuator return pressure in fluid communication with an actuator configured to operate using pressurized fluid from the system, the pump control providing a selective pump control pressure to the pump load system control;

wherein when the system is operating in a standby mode, the pump control is urged to the first arrangement, the pump control pressure being insufficient to overcome the first load sensor pressure applied to a control valve associated with the pump load system control, resulting in the pump operating in a first minimized displacement condition;

wherein when the system is in a stall mode, the pump control is urged to the second arrangement by the actuator return pressure, the pump control pressure being sufficient to overcome the first load sensor pressure as applied to the control valve associated with the pump load system control, resulting in the pump operating in a second minimized displacement condition.

2. The system of claim 1, wherein in the standby mode, the pump control pressure is vented to a reservoir.

3. The system of claim 1, wherein the system includes a first flow restriction device in communication with the first load sensor pressure in standby mode, the first flow restriction device configured to permit a predetermined flow rate in the standby mode and corresponding to the first minimized displacement condition of the pump.

4. The system of claim 1, wherein a relief valve is in fluid communication with the pump to prevent overpressurization of fluid in the system.

5. A fluid control system comprising:

a variable displacement pump having a load system control and configured to operate in an open center mode; and a pump control operable between a first arrangement and a second arrangement, the pump control receiving pressurized fluid from a first load sensor pressure in fluid communication with the pump and an actuator return pressure in fluid communication with an actuator configured to operate using pressurized fluid from the system, the pump control providing a selective pump control pressure to the pump load system control;

wherein when the system is operating in a standby mode, the pump control is urged to the first arrangement, the pump control pressure being insufficient to overcome the first load sensor pressure applied to a control valve associated with the pump load system control, resulting in the pump operating in a first minimized displacement condition;

wherein when the system is in a stall mode, the pump control is urged to the second arrangement, the pump control pressure being sufficient to overcome the first load sensor pressure as applied to the control valve associated with the pump load system control, resulting in the pump operating in a second minimized displacement condition wherein the system includes a first flow restriction device in communication with the first load sensor pressure in standby mode, the first flow restriction device configured to permit a predetermined flow rate in the standby mode and corresponding to the first minimized displacement condition of the pump;

the system includes a second flow restriction device in fluid communication with a second load sensor pressure, the second flow restriction device permitting fluid flow at a pressure less than the first flow restriction device.

6. The system of claim 5, wherein the pump control valve is configured to operate between a first position in response to the pump control operating in the first arrangement, and a second position in response to the pump control operating in the second arrangement.

7. The system of claim 6, wherein when the pump control operates in the second arrangement, the pump control valve is in fluid communication with the second load sensor pressure.

8. A work machine comprising:

a fluid control system comprising:

a variable displacement pump having a load system control and configured to operate in an open center mode; and a pump control operable between a first arrangement and a second arrangement, the pump control receiving pressurized fluid from a first load sensor pressure in fluid communication with the pump and an actuator return pressure in fluid communication with an actuator configured to operate using pressurized fluid from the system, the pump control providing a selective pump control pressure to the pump load system control;

wherein when the system is operating in a standby mode, the pump control is urged to the first arrangement, the pump control pressure being insufficient to overcome the first load sensor pressure applied to a control valve associated with the pump load system control, resulting in the pump operating in a first minimized displacement condition;

wherein when the system is in a stall mode, the pump control is urged to the second arrangement by the actuator return pressure, the pump control pressure being sufficient to overcome the first load sensor pressure as applied to the control valve associated with the load system control of the pump, resulting in the pump operating in a second minimized displacement condition.

9. The work machine of claim 8, wherein in the standby mode, the pump control pressure is vented to a reservoir.

10. The work machine of claim 8, wherein the system includes a first flow restriction device in communication with the first load sensor pressure, the first flow restriction device configured to permit a predetermined flow rate in the standby mode and corresponding to the first minimized displacement condition of the pump.

11. The work machine of claim 10, wherein the system includes a second flow restriction device in fluid communication with a second load sensor pressure, the second flow restriction device permitting fluid flow at a pressure less than the first flow restriction device.

12. The work machine of claim 11, wherein the pump control valve is configured to operate between a first position in response to the pump control operating in the first arrangement, and a second position in response to the pump control operating in the second arrangement.

13. The work machine of claim 12, wherein when the pump control operates in the second arrangement, the pump control valve is in fluid communication with the second load sensor pressure.

14. The work machine of claim 8, wherein a relief valve is in fluid communication with the pump to prevent overpressurization of fluid in the system.

* * * * *